US010986906B2

(12) United States Patent
Abramowitz et al.

(10) Patent No.: US 10,986,906 B2
(45) Date of Patent: Apr. 27, 2021

(54) HEATED EQUIPMENT BAG

(71) Applicants: David Eric Abramowitz, Westwood, MA (US); Fernando Alberto Robert, San Francisco, CA (US)

(72) Inventors: David Eric Abramowitz, Westwood, MA (US); Fernando Alberto Robert, San Francisco, CA (US)

(73) Assignee: KULKEA, LLC, Westwood, MA (US)

( * ) Notice: Subject to any disclaimer, the term of this patent is extended or adjusted under 35 U.S.C. 154(b) by 0 days.

(21) Appl. No.: 16/220,007

(22) Filed: Dec. 14, 2018

(65) Prior Publication Data

US 2019/0191835 A1 Jun. 27, 2019

Related U.S. Application Data

(60) Provisional application No. 62/608,584, filed on Dec. 21, 2017.

(51) Int. Cl.

| | |
|---|---|
| ***A45C 3/12*** | (2006.01) |
| ***A63B 71/00*** | (2006.01) |
| ***B65D 30/22*** | (2006.01) |
| ***A45C 3/02*** | (2006.01) |
| ***A45C 13/03*** | (2006.01) |
| ***A45C 15/00*** | (2006.01) |
| ***A63B 22/00*** | (2006.01) |
| ***A45C 3/00*** | (2006.01) |
| ***A45C 13/02*** | (2006.01) |
| *A63B 21/00* | (2006.01) |

(52) U.S. Cl.

CPC ..... *A45C 3/12* (2013.01); *A45C 13/02* (2013.01); *A45C 13/03* (2013.01); *A45C 15/00* (2013.01); *A63B 22/0046* (2013.01); *A63B 22/0076* (2013.01); *A63B 71/0036* (2013.01); *B65D 31/12* (2013.01); *A45C 2003/007* (2013.01); *A63B 21/153* (2013.01); *A63B 2022/0079* (2013.01); *A63B 2225/64* (2013.01); *A63B 2244/19* (2013.01)

(58) Field of Classification Search

CPC ..... A45C 3/12; A45C 13/02; A63B 71/0036; B65D 31/12

USPC ..... 224/101; 36/2.6

See application file for complete search history.

(56) References Cited

U.S. PATENT DOCUMENTS 1,761,829 A * 6/1930 Heinemann ..... A43B 7/025 36/2.6
2,402,726 A * 6/1946 Bonyhady ..... A43B 23/07 36/2.6
4,023,282 A * 5/1977 Ziegelheafer ..... A43B 7/02 36/2.6
4,094,080 A * 6/1978 Sanders ..... A43B 7/02 126/206

(Continued)

*Primary Examiner* — Nathan J Newhouse
*Assistant Examiner* — Lester L Vanterpool
(74) *Attorney, Agent, or Firm* — Hunter Clark PLLC

(57) ABSTRACT

A heated equipment bag includes: a housing providing a first compartment configured to receive a first piece of footwear, the housing further providing a second compartment configured to receive a second piece of footwear, the first compartment being separate from the second compartment; a first heater disposed in the first compartment and configured to produce heat; and a second heater disposed in the second compartment and configured to produce heat.

15 Claims, 7 Drawing Sheets

(56) References Cited

U.S. PATENT DOCUMENTS 4,210,186 A * 7/1980 Belenson ..... A45C 3/00 190/110
4,455,764 A * 6/1984 Rock ..... A43B 7/02 36/136
4,830,154 A * 5/1989 Gerch ..... A45C 3/00 190/103
4,841,646 A * 6/1989 Maurer, Jr. ..... A43B 7/02 126/204
5,105,919 A * 4/1992 Bomes ..... A45C 3/00 150/117
5,187,814 A * 2/1993 Gold ..... A41B 11/00 2/160
5,471,767 A * 12/1995 Walker ..... A43B 7/02 126/204
5,569,401 A * 10/1996 Gilliland ..... A47K 10/06 219/386
5,779,036 A * 7/1998 Westbrook ..... A45F 3/04 190/102
6,185,845 B1 * 2/2001 Gordon ..... A43B 1/00 36/2.6
6,382,377 B2 * 5/2002 Godshaw ..... A45C 13/02 190/109
6,969,831 B1 * 11/2005 Parker ..... H05B 3/342 219/212
7,600,620 B2 * 10/2009 Hammond ..... A45C 7/009 150/111
9,016,494 B1 * 4/2015 Hernandez ..... A45F 3/02 220/6
9,511,921 B2 * 12/2016 Crowe ..... A45C 13/26
2002/0179664 A1 * 12/2002 Worden, IV ..... A45C 3/12 224/586
2004/0163279 A1 * 8/2004 Gadson ..... A43B 3/16 36/7.1 R
2004/0250445 A1 * 12/2004 Pritchett ..... A43B 7/125 36/2.6
2005/0127056 A1 * 6/2005 Petkov ..... D06F 58/14 219/211
2005/0189344 A1 * 9/2005 Bachman ..... A43B 5/0425 219/528
2006/0201979 A1 * 9/2006 Achilles ..... B62B 3/1464 224/411
2006/0248747 A1 * 11/2006 Reid ..... A43B 7/025 36/2.6
2010/0314381 A1 * 12/2010 Wang ..... H05B 3/36 219/494
2014/0061273 A1 * 3/2014 Bullivant ..... A45F 3/04 224/576
2015/0001238 A1 * 1/2015 Franklin ..... A47K 10/421 221/45
2016/0095400 A1 * 4/2016 Lawton ..... A45C 3/12 206/292
2018/0279728 A1 * 10/2018 Marrello ..... A45C 13/262

* cited by examiner

HEATED EQUIPMENT BAG

CROSS-REFERENCE TO RELATED APPLICATIONS

This application claims the benefit of U.S. Provisional Application No. 62/608,584, filed Dec. 21, 2017, entitled "HEATED EQUIPMENT BAG," the entire contents of which are hereby incorporated herein by reference.

BACKGROUND

Winter sport (e.g., cold-weather sport) activities often involve the use of bulky equipment. For example, skiing equipment typically includes bulky ski boots, poles, gloves, insulated pants, an insulated coat, and a helmet. As another example, snowboarding equipment typically includes a similar list, but with snowboard boots instead of ski boots and without poles. Transporting this equipment, e.g., to a user's vehicle and from the user's vehicle to a ski lodge, can be cumbersome.

A common theme with winter sport equipment is an ability of the equipment to keep a user warm. If, however, the equipment is cold to begin with, the equipment may be difficult to put on or the user (or at least a portion of the user in contact with the equipment) may take longer to warm up, or may never fully warm up, particularly if the equipment that is cold is for use with a user's extremities such as hands or feet.

Equipment bags may be used to help transport, and even heat, winter sport equipment. For example, bags exist that can contain ski boots or snowboard boots within a large compartment that has a heating element in the bottom and one or more walls of the compartment. The heating element is configured to receive power from a wall outlet or an automobile power socket and to radiate heat within the compartment.

SUMMARY

An example of a heated equipment bag includes: a housing providing a first compartment configured to receive a first piece of footwear, the housing further providing a second compartment configured to receive a second piece of footwear, the first compartment being separate from the second compartment; a first heater disposed in the first compartment and configured to produce heat; and a second heater disposed in the second compartment and configured to produce heat.

Implementations of such an equipment bag may include one or more of the following features. The first heater is disposed along at least opposing first wall portions of the housing providing the first compartment and wherein the second heater is disposed along at least opposing second wall portions of the housing providing the second compartment. The housing is configured to increase a volume of the first compartment in response to receiving the first piece of footwear and the opposing first wall portions are configured to conform to an exterior surface of the first piece of footwear. The opposing first wall portions are portions of sidewalls providing the first compartment and the first heater is further disposed along a bottom wall portion of the housing providing the first compartment. The first heater comprises a monolithic heating element disposed along the opposing first wall portions of the housing and the bottom wall portion of the housing.

Also or alternatively, implementations of such an equipment bag may include one or more of the following features. The housing provides a third compartment between and separating the first compartment and the second compartment. The equipment bag may include a shoulder strap attached to the housing. The housing comprises an inner sidewall and an outer sidewall providing boundary portions of the first compartment, wherein the inner sidewall is disposed closer to a vertical centerline of the equipment bag than the outer sidewall. The equipment bag may include a switch coupled to the first heater and configured to be selectively actuated to control an amount of heat produced by the first heater. The equipment bag may include a thermally-reflective material disposed between the first heater and a vertical centerline of the housing, or between the first heater and an exterior wall of the housing, or both. The first heater is disposed in a first pouch that is removably attached to the housing and the second heater is disposed in a second pouch that is removably attached to the housing.

An example of a heated boot bag includes: a housing providing a compartment configured to receive a first boot and a second boot; and a heater disposed in the compartment and including: a first heating element portion disposed along at least a portion of a first wall of the compartment; a second heating element portion disposed along at least a portion of a second wall of the compartment, opposing the first wall of the compartment; and a third heating element portion disposed between the first heating element portion and the second heating element portion; where the heater is configured to receive the first boot between the first heating element portion and the third heating element portion in a first sub-compartment defined by the heater and to receive the second boot between the second heating element portion and the third heating element portion in a second sub-compartment defined by the heater; and where the housing and the heater are configured to increase a volume of the first sub-compartment in response to the heater receiving the first boot in the first sub-compartment and to have the heater conform to an exterior surface of the first boot.

Implementations of such a boot bag may include one or more of the following features. Each of the first heating element portion, the second heating element portion, and the third heating element portion is flexible. Each of the first wall and the second wall is a respective sidewall of the compartment and the heater further includes at least one fourth heating element portion disposed along at least a portion of a bottom of the compartment whereby the at least one fourth heating element portion will be disposed adjacent to a bottom of the first boot and a bottom of the second boot with the first boot received between the first heating element portion and the third heating element portion and the second boot received between the second heating element portion and the third heating element portion. Each of the first heating element portion, the second heating element portion, and the third heating element portion is a respective portion of a single heating element. Each of the first heating element portion, the second heating element portion, and the third heating element portion is disposed in a respective pouch.

DETAILED DESCRIPTION

Techniques are discussed herein for transporting and heating items such as clothing or other equipment, e.g., winter-sport equipment. For example, an equipment bag provides multiple compartments each configured to receive and retain a piece of equipment. Of these compartments, there may be at least two compartments each configured to receive and retain a piece of winter-sport footwear such as a ski boot, a snowboard boot, a cross-country ski boot, an ice skate, etc. Each of these compartments may contain a heating element configured to provide heat, e.g., to heat one or more items contained in the respective compartment. Each heating element may be flexible to help adapt to an outer shape of the footwear. Each heating element may be contained in a flexible pouch and each pouch may be at least partially detachable from the equipment bag. Also or alternatively, each pouch may be attachable to itself, to help conform to the outer shape of the footwear to improve heat transfer to the footwear. Each pouch and heating element combination may be configured to contact, and heat, the footwear on two sides of the footwear and a bottom of the footwear. These examples, however, are not exhaustive.

Items and/or techniques described herein may provide one or more of the following capabilities, as well as other capabilities not mentioned. Equipment such as footwear may be better heated in an equipment bag than with prior art equipment bags, e.g., by using individual heating apparatus for each piece of footwear and/or by having conformable heating apparatus. Equipment such as footwear may be better heated than with prior devices, e.g., by directly contacting the equipment on three surfaces of the equipment with a heating pad, e.g., two sides and a bottom of footwear. One or more hard items, such as hard-plastic boots, may be softened to make the item(s) pliable (or more pliable) at least temporarily, for example to facilitate putting on a ski boot. Clothing and/or footwear may be heated to provide warm clothing or footwear when initially put on. Heating of items to different temperatures and/or heating of items not desired to be heated in an equipment bag may be inhibited. Other capabilities may be provided and not every implementation according to the disclosure must provide any, let alone all, of the capabilities discussed. Further, it may be possible for an effect noted above to be achieved by means other than that noted, and a noted item/technique may not necessarily yield the noted effect.

Figure 1:
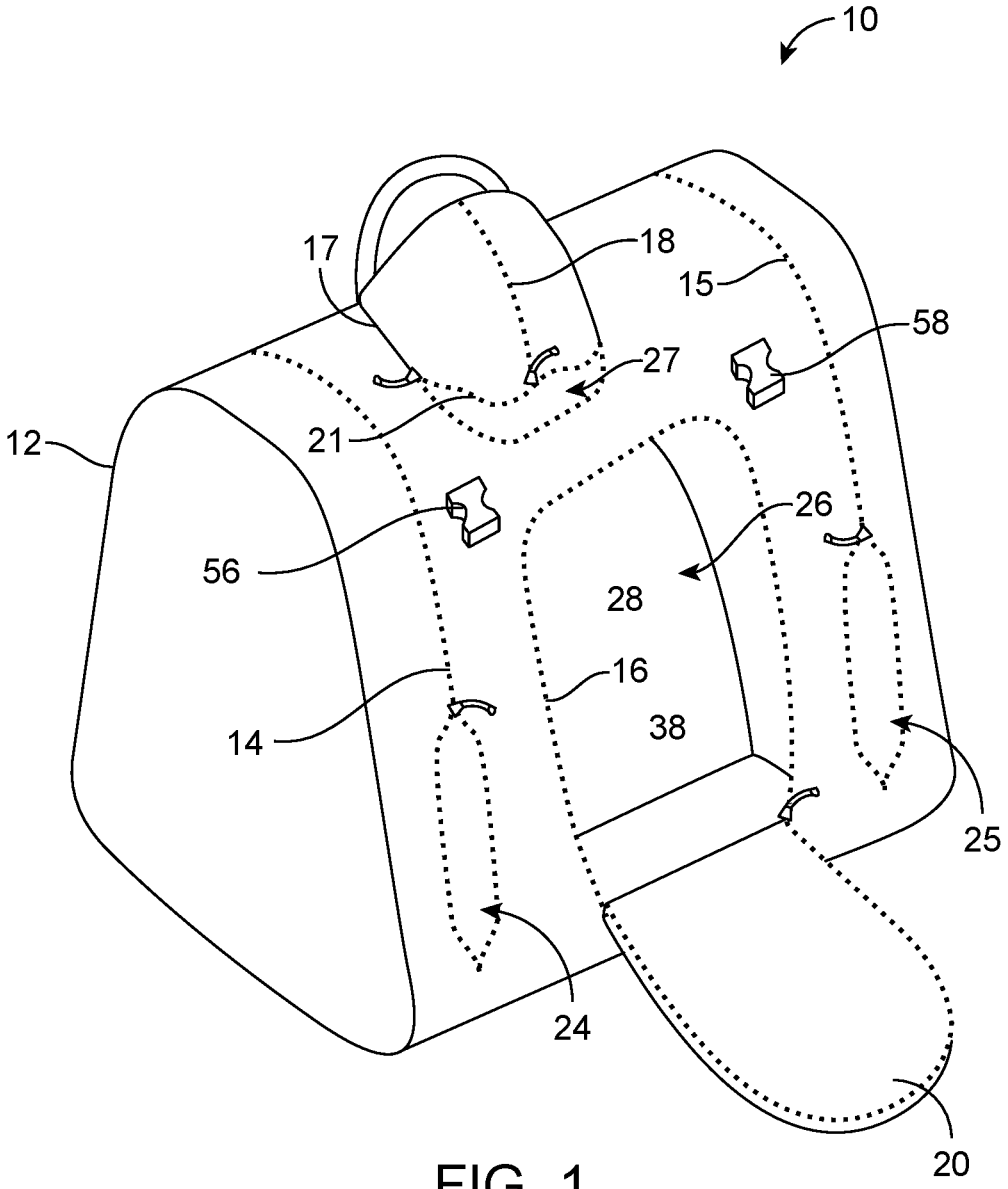
FIG. 1 is a front and side perspective view of a heated equipment bag.

Referring to FIG. 1, a heated equipment bag 10 includes a housing 12 that includes reusable closures 14, 15, 16, 17, 18, a front flap 20, and a top flap 21. For example, the reusable closures 14-18 provide repeated access to compartments within the housing 12. For example, the closures 14, 15 are configured to provide access to, and the means for securing, compartments 24, 25 for storing equipment, including winter-sport equipment, e.g., footwear such as downhill ski boots, cross-country ski boots, snowboard boots, ice skates, etc. In this example, the compartments 24, 25 are separate (as opposed to one big compartment), being separated from each other by two other compartments 26, 27, and are disposed at opposite ends of the equipment bag 10. Here, the compartment 26 is provided behind the front flap 20 of the housing 12 and in front of a panel 28, with the compartment 27 disposed behind the panel 28 and accessible by opening (e.g., unzipping) the closure 17 and lifting the top flap 21. The compartment 26 is provided by the housing 12 between and separating the compartments 26, 27. The closure 16 may, for example, provide access to the compartment 26 for storing food, drink and/or miscellaneous gear and/or apparel such as gloves, a beanie, etc. The closure 17 may, for example, provide access to the compartment 27 such that the compartment 27 is a top-loading central compartment for storing larger items such as ski pants, base layers, tops, etc. The top flap 21 may be a pouch such that the closure 18 may, for example, provide access to a small compartment for storing items such as apparel including, e.g., face masks, bandanas and/or balaclavas, etc., as well as other gear. The closures 14-18 may be, for example, zippers, although other forms of closures may be used, and different ones of the closures 14-18 may be different types of closures. The closures 14-17 may provide selective access to the compartments 24-27, e.g., by unzipping the closures 14-17 and may close the compartments 24-27 to help retain items in the compartments 24-27. Further, the arrangement of the closures 14-18 is an example only and other configurations, including more or fewer closures and/or different arrangements of closures, may be used.

Figure 2:
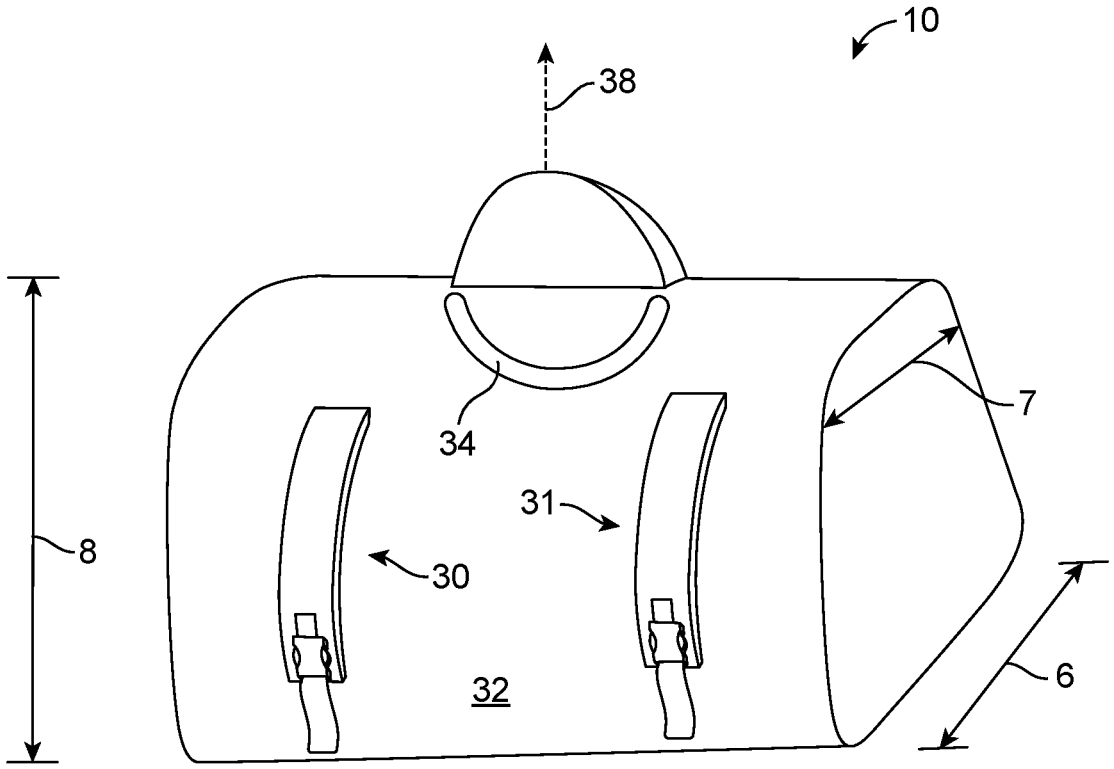
FIG. 2 is a rear and side perspective view of the heated equipment bag shown in FIG. 1.

Referring also to FIG. 2, the equipment bag 10 may be configured as a backpack. The equipment bag 10 may further include backpack-style shoulder straps 30, 31 attached to a back side 32 of the equipment bag 10 to allow a user to carry the equipment bag 10 easily, even while containing winter sport equipment. The shoulder straps 30, 31 are attached to the equipment bag 10 on opposite sides of a vertical centerline 38 of the housing 12. The shoulder straps 30, 31 may be attached to the housing 12 at an attachment point that is closer to the centerline than inner walls defining the compartments 24, 25 (e.g., the strap 30 may be attached to the housing 12 closer to the centerline 38 than a panel 96 shown in FIGS. 5 and 6. Alternatively, the equipment bag 10 could be configured for carrying over one shoulder, e.g., having a single shoulder strap or a strap connected at a top of each end of the equipment bag 10. Also or alternatively, the equipment bag 10 may include a handle 34 configured to be grasped by a user and to support the weight of the bag 10 and contents of the bag 10, e.g., ski boots, ski pants, a helmet, food, drink, etc. The equipment bag 10 may be sized and shaped to accommodate footwear to be heated. For example, the equipment bag 10 may have a trapezoidal shape for receiving ski boots. For example, the equipment bag 10 may have a base length 6 of about 14 inches (36 cm), a top length 7 of about 7.5 inches (19 cm), and a height 8 of about 16 inches (41 cm). These dimensions are examples only and one or more other dimensions may be used.

Figure 3:
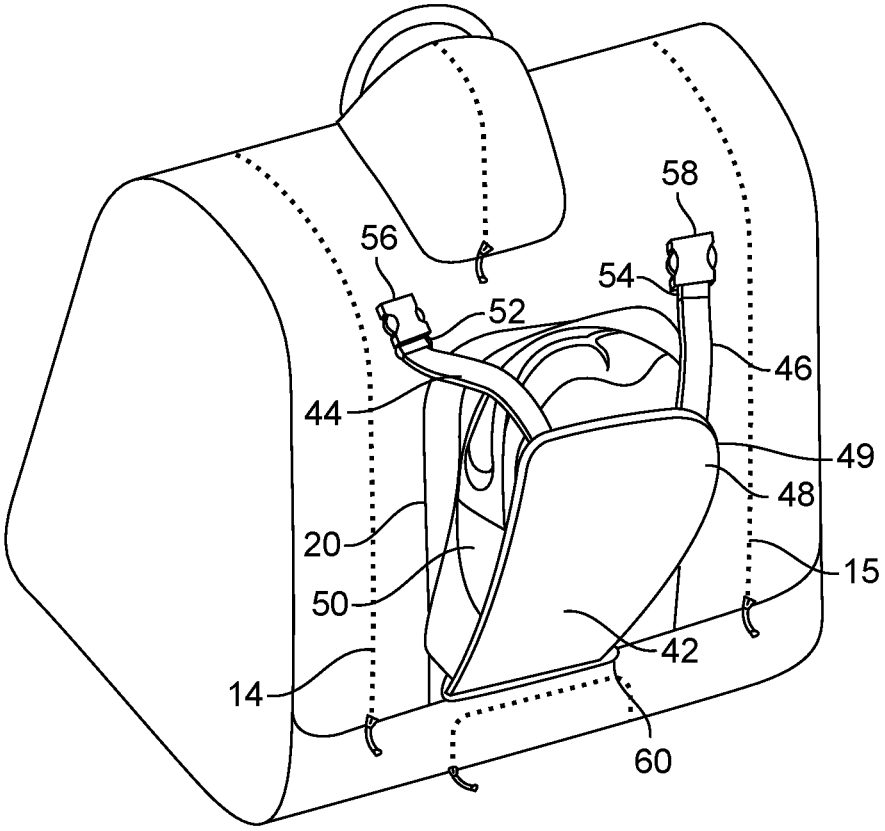
FIG. 3 is a front and side perspective view of the heated equipment bag shown in FIG. 1 holding a helmet in a helmet sling.

Referring also to FIG. 3, the equipment bag 10 may further include a helmet sling 42. The helmet sling 42 in this example includes straps 44, 46, and a flap 48 and is configured to help retain a helmet 50 against, and outside, the housing 12, here against the front flap 20. The straps 44, 46 may be made of a flexible material such as a nylon webbing, and have connectors 52, 54 slidably attached thereto and configured to connect to mating connectors 56, 58 attached to an exterior of the housing 12. The connectors 52, 54, 56, 58 may be mating portions of side-release or quick-release buckles. The flap 48 is pivotally attached to the housing 12 such that the helmet 50 may be placed against a surface of the housing 12, and the flap 48 pivoted around and into contact with the helmet 50, and the connectors 52, 54 connected to the connectors 56, 58. The flap 48 may have a stretchable border 49 to help the helmet sling 42 accommodate different sizes of helmets. The straps 44, 46 may be slidably adjusted through the connectors 52, 54 to tighten the flap 48 against the helmet 50. In this example, the helmet sling 42 may be stored in a pouch of the front flap 20 and accessed by opening a closure 60 and pulling the helmet sling 42 from the pouch.

Figure 4:
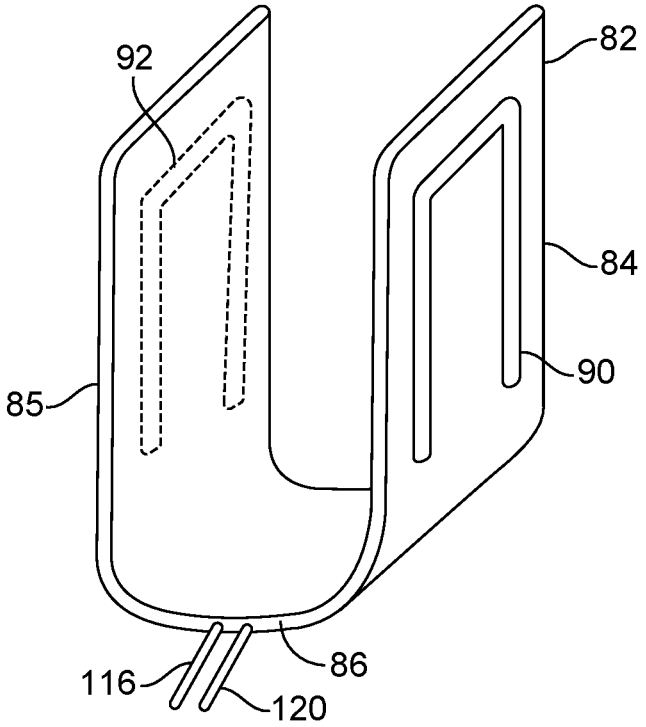
FIG. 4 is a perspective view of a heating pad.
Figure 5:
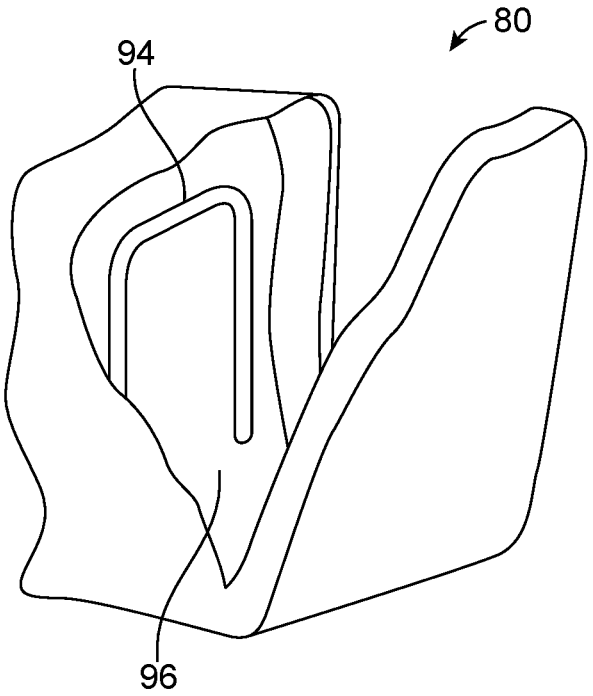
FIG. 5 is a perspective view of a portion of the equipment bag shown in FIG. 1 with a closure open to expose a compartment for receiving the heating pad shown in FIG. 4 and one or more items to be heated.
Figure 6:
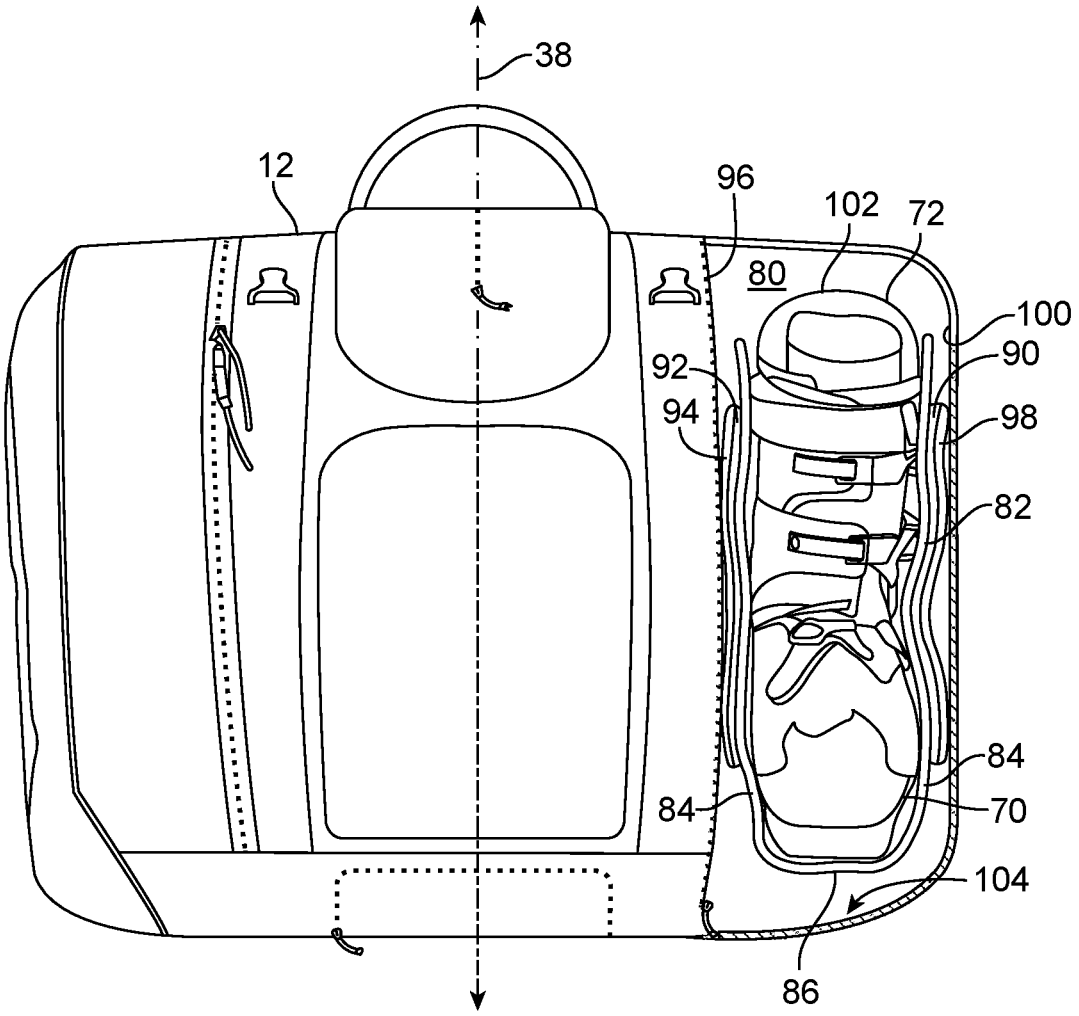
FIG. 6 is a partially cut-away front view of the equipment bag shown in FIG. 1 showing the heating pad shown in FIG. 4 in use with a ski boot.

Referring to FIGS. 4-6, with further reference to FIGS. 1-3, the closures 14, 15 may be opened to provide access to compartments, each of which is at least partially lined by a heating pad configured to produce heat. For example, the closure 15 may be opened to provide access to a compartment 80 (i.e., the compartment 25 shown in FIG. 1), with the housing 12 and a heating pad 82 configured such that the compartment 80 can receive and hold the heating pad 82. The heating pad 82 includes a right-side pouch 84, a left-side pouch 85, and a bottom pouch 86. The pouches 84-86 form a clamshell-shaped structure configured to receive a piece of equipment. The pouches 84-86 are shown as portions of a single, continuous pad, but this is not required. The pouches 84-86 may be separate pieces that may or may not be connected to an adjacent panel (e.g., adjacent panels sewn to each other along a seam). The heating pad 82 may be configured to be removably attached to the housing 12, e.g., to panels defining the compartment 80. Here, for example, the right-side pouch 84 includes a fastener 90 and the left-side pouch 85 includes a fastener 92 on respective outside surfaces. The fastener 92 is configured to removably and repeatedly attach to a mating fastener 94 on the panel 96 of the housing 12. For example, the fasteners 92, 94 may be respective portions of a hook-and-loop fastening system. A fastener 98 (FIG. 6) may also be provided on a panel 100 of the housing 12 for removably and repeatedly attaching to the fastener 90. The panels 96, 100 provide opposing sidewalls and boundary portions of the housing 12, e.g., an inner wall and an out wall defining the compartment 80. The fasteners 90, 92, 94, 98 may help hold the heating pad 82 in place in the compartment 80 to help heat an item, such as a ski boot 102. The fasteners 90, 92, 94, 98 are disposed to align with each other and configured to releasably attach to each other to align and retain the heating pad 82 in the compartment 80. When in the housing 12, the heating pad 82 may provide at least a portion of at least one wall defining the compartment 80, here providing portions of side walls and a bottom wall defining the compartment 80. The heating pad 82 may be removed from the equipment bag 10, e.g., to be replaced by a replacement heating pad. The panels 96, 100 may comprise a thermally-reflective material to reflect heat and to help heat the ski boot 102 (and/or other item(s)) and/or to limit or inhibit heating of items in other compartments in the equipment bag 10. The use of reflective material may help retain heat within the compartment 80 and thus improve efficiency of the heating pad 82 and/or reduce wasted energy from the heating pad 82. One or more other surfaces defining the compartment 80 may comprise a thermally-reflective material. For a panel or surface to comprise a thermally-reflective material, the panel may be made of the thermally-reflective material, or have the material coated on the panel or surface (e.g., painted on), and/or may have a thermally-reflective sheet of material attached to the housing 12, etc. The housing 12 may include insulating material disposed about the compartment 80, e.g., between panels defining the compartment 80 and exterior panels of the housing 12.

The equipment bag 10 is configured such that the compartment 80 in a resting state has a volume that is smaller than a volume occupied by the ski boot 102 such that with the ski boot 102 disposed in the compartment 80 and the closure 15 closed, the pouches 84, 85 and/or the panels 96, 100 (e.g., opposing walls defining the compartment 80) are biased toward sides of the ski boot 102. The equipment bag 10, and in particular the housing 12, is configured to increase volume of the compartment 80 and the pouches 84, 85 are configured to adapt (e.g., are flexible) to portions of a piece of footwear (e.g., the ski boot 102) or other item received by the compartment 80 in response to the compartment 80 receiving the piece of footwear (or other item). For example, portions of the pouches 84, 85 may contact and conform to an exterior shape of the ski boot 102 where the pouches 84, 85 contact the ski boot 102. The pouches 84, 85 and/or the panels 96, 100 may be pressed against the sides of the ski boot 102 causing the pouches 84, 85 to at least partially conform to, and be in contact with, respective sides (exterior side surfaces) of the ski boot 102. The pouch 86 may be disposed along a bottom wall 104 of the housing 12 defining the compartment 80. The heating pad 82 thus has a clamshell or taco shape, receiving the ski boot 102. The pouches 84, 85 may be configured to releasably attach to each other, e.g., along at least portions of lengths of the pouches 84, 85, to wrap around a received item, e.g., the ski boot 102, to have even more surface area of the item in contact with the heating pad 82.

The heating pad 82 comprises a flexible material, e.g., forming a pouch, containing one or more heat exchangers such as electrically-conductive wires or coils. For example, the heating pad 82 may comprise multiple sheets of the flexible material, such as a woven nylon, that are sewn together to form a pouch to retain the one or more heat exchangers. The heating pad 82 is configured (e.g., sized and composed of appropriate materials) to adapt to an outer shape of an item disposed in the compartment 80, such as the ski boot 102, a snowboarding boot, a cross-country ski boot, an ice skate, etc. The heating pad 82 may substantially conform to a significant portion of an outer surface of, for example, the ski boot 102. The heating pad 82 may conform to the outer surface of the ski boot 102 within constraints of the flexibility of the heating pad 82 and variations of the outer surface of the ski boot 102 relative to a smooth surface. While the ski boot 102 is shown and discussed, this is an example only and other types of equipment may be used with the heating pad 82. Substantially conforming to the ski boot 102 may help the heating pad 82 to contact a greater amount of a surface area of the ski boot 102 than, for example, a heating pad that was less flexible and/or was configured to receive multiple ski boots, and thus perhaps contacting only one side of each of the boots. Conforming to the ski boot 102 may help conductive heat transfer from the heating pad 82 to the ski boot 102 by increasing pad-to-boot contact and reducing air gaps between the heating pad 82 and the ski boot 102. The heating pad 82 may be configured to allow a toe portion 70, and/or a top portion 72, of the ski boot 102 to extend outside of the heating pad 82, e.g., in order to accommodate different sizes of ski boots (or other equipment) and/or to facilitate moisture, odors, etc. to escape from the ski boot 102.

The heating pad 82 in the compartment 80 may be electrically coupled to a similarly-configured heating pad in a compartment accessible through the closure 14. The heating pad 82 and the complementary heating pad may be electrically coupled to each other via one or more wires passing, e.g., along a bottom of the equipment bag 10, along the back of the equipment bag 10, or elsewhere. Alternatively, the heating pad 82 and the complementary heating pad may each couple to a power source but not be directly coupled to each other. The heating pads may efficiently heat equipment within respective compartments of the equipment bag 10 while limiting or inhibiting heat from the heating pads from heating other items stored in the equipment bag 10 (e.g., in other compartments). For example, heat may be inhibited from reaching heat-sensitive items such as food, drinks, leather gloves, water-resistant-coating apparel, etc. in compartments other than the compartments in which the heating pads are disposed.

Figure 7:
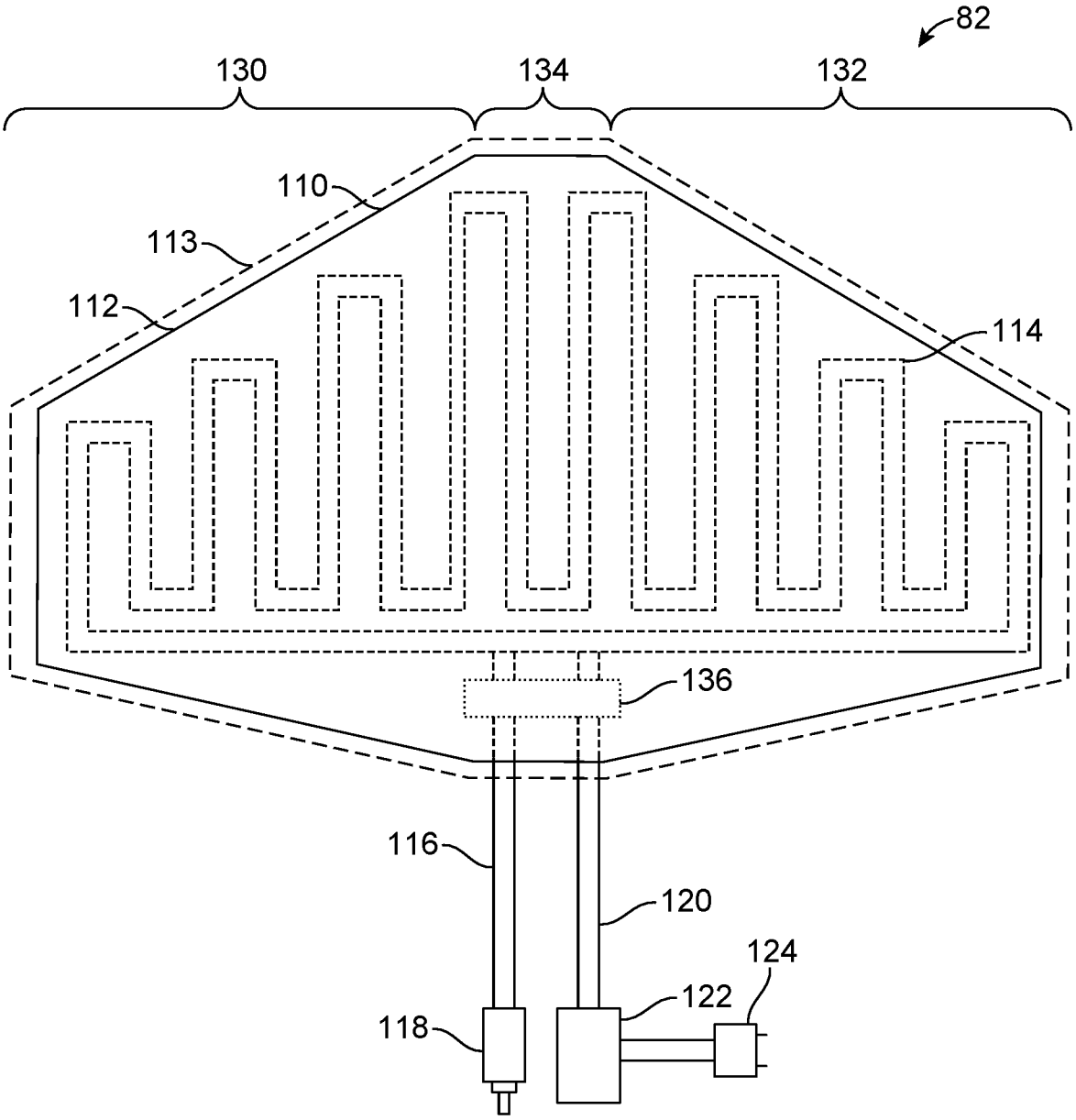
FIG. 7 plan view of the heating pad shown in FIG. 4.

Referring also to FIG. 7, a heat exchanger 110 of the heating pad 82 includes a flexible pouch 112 and a transducer 114. The transducer 114 may be disposed in the pouch 112, and the pouch 112 disposed in a pouch 113 of the heating pad 82. The flexible pouch 112 is configured to contain the transducer 114 and inhibit direct contact with the transducer 114, while allowing the heating pad 82 to be manipulated into the U-shaped configuration shown in FIGS. 4 and 6 and to conform to an item in the compartment 80, and while allowing heat to be emitted through the pouch 112. The transducer 114 is configured to convert electric energy into heat and to be flexible to permit the heating pad 82 to be manipulated into the U-shaped configuration shown in FIGS. 4 and 6 and to conform to an item in the compartment 80. The transducer 114 may be a monolithic heating element and may be disposed and configured to provide heat in each of the pouches 84-86. In this example, the transducer 114 is a coil, but other configurations of transducers may be used. The transducer 114 may be configured to accept power from a wall outlet, an automobile power socket, and/or a battery contained by the equipment bag 10. For example, the transducer 114 may be coupled through a cord 116 to an adapter 118 configured to fit into an automobile power socket that provides 12V power. Also or alternatively, the transducer 114 may be connected to an electrical cord 120 connected to a power selector 122 and a plug 124 adapted to be inserted into a wall outlet that provides 120V power. The transducer 114 may also or alternatively be connected to a cable that connects to a battery. Also or alternatively, the heat exchanger 110 may include a battery that may be recharged, e.g., by connecting the battery to a wall outlet or an automobile power socket, or by being wirelessly recharged, etc. One or more of the cords 116, 120 may also be connected to another heater, e.g., another transducer of another heating pad in the equipment bag 10 to cause the other transducer to provide heat. While only the heating pad 82 is discussed in detail here, a similar heating pad may be provided in another compartment, e.g., the compartment 24 shown in FIG. 1, which may be defined by the housing 12 similarly to (e.g., a mirror image of) the compartment 25 (i.e., the compartment 80), e.g., with a heater disposed along opposing walls defining the compartment, etc.

The amount of electricity provided to the heating pad 82, and thus the time it takes to heat and/or the amount of heat produced by the heating pad 82, may be adjusted and/or regulated. For example, the power selector 122 may allow a user to select from multiple heat settings, e.g., low, medium, high, and off, of the power selector 122 that regulates an amount of electricity provided to the transducer 114. The power selector 122 (e.g., a switch) may be selectively actuated, e.g., by a user, to select a desired setting of multiple heat settings in order to control an amount of heat produced, e.g., to provide a desired heat level (e.g., low, medium, or high) by the heating pad 82. Also or alternatively, the heating pad 82 may be configured to automatically turn off the heating pad 82 (e.g., stop power flow to the transducer 114) in response to a high-temperature threshold being reached or exceeded, or a heating time threshold being reached or exceeded. For example, the user may be able to select a desired temperature for the compartment 80. The heating pad 82 may include a power regulator 136 that is configured to automatically turn off the heating pad 82 in response to a high-temperature threshold being reached or exceeded. For example, with the power regulator 136 may comprise a thermostat disposed inside the pouch 113 as shown, the power regulator 136 may be configured to turn off the transducer 114 if a temperature sensed by the thermostat reaches 140° F. This may help prevent the heating pad 82 from over-heating items by helping to keep a temperature of items in the compartment 80 less than about 115° F., e.g., between about 105° F. and 115° F. The power regulator 136 could be disposed outside of the pouch 113 and the threshold temperature for shut down of the transducer 114 may be set to, for example, 115° F. The heating pad 82 may thus be configured to inhibit over-heating of items in the compartment 80, allowing the items to be warmed while inhibiting the items from becoming hot, at least to the point of damaging the items. Thus, for example, the boot 102 may be warmed to improve boot fit to thereby improve comfort, performance, and/or safety while inhibiting risk of damage to the boot 102. The power regulator 136 may also be configured to automatically turn on the heating pad 82, e.g., supply power to the transducer 114, in response to a temperature sensed by the thermostat reaching or falling below a low-temperature threshold. Temperature thresholds may be fixed or variable, e.g., with the heating pad 82 being configured such that a user may set one or more of the temperature thresholds. Also or alternatively, the power regulator 136 may be configured to shut off the heating pad 82 in response to a threshold amount of heating time being reached or exceeded, e.g., a timer expiring where the timer is started when the transducer 114 is powered up.

The heating pad 82 may be sized and shaped to fit within the compartment 80 and cover a substantial portion of the panels 96, 100 and/or such that the heating pad 82 will cover substantial portions of each side of the item, e.g., footwear, received in the compartment 80 by the heating pad 82. As shown in FIG. 7, the heating pad 82 has two side sections 130, 132 and a middle section 134. The side sections 130, 132 have asymmetrical trapezoidal shapes of similar shape, but smaller in size, than the panels 96, 100 of the housing 12. The middle section 134 is rectangular, having a length close to a depth of the housing 12, i.e., close to the base length 6 (see FIG. 2) and a width of about 4 inches (10 cm) that may be about a width of an item (e.g., the ski boot 102) expected to be received by the heating pad 82, or slightly smaller than this width. While the transducer 114 is shown being asymmetrical, symmetrical arrangements may be used, or other asymmetrical arrangements may be used.

Numerous modifications to the above examples may be made. For example, insulation may be provided between a heating element and a compartment that does not contain a heating element. This may help prevent undesired or unintended heating of items in the compartment not containing a heating element. For example, such insulation may help prevent drinks or food from being heated due to proximity to a heating element in another compartment.

Other Considerations

Other examples and implementations are within the scope and spirit of the disclosure and appended claims. Substantial variations may be made in accordance with specific requirements. For example, a heating pad may include padding such that the heating pad may heat and help protect items received by the heating pad. Also or alternatively, a heating pad may be integral with a housing of an equipment bag, e.g., forming a panel (possibly including an exterior panel of the bag) that partially defines a compartment for receiving equipment to be heated.

Figure 8:
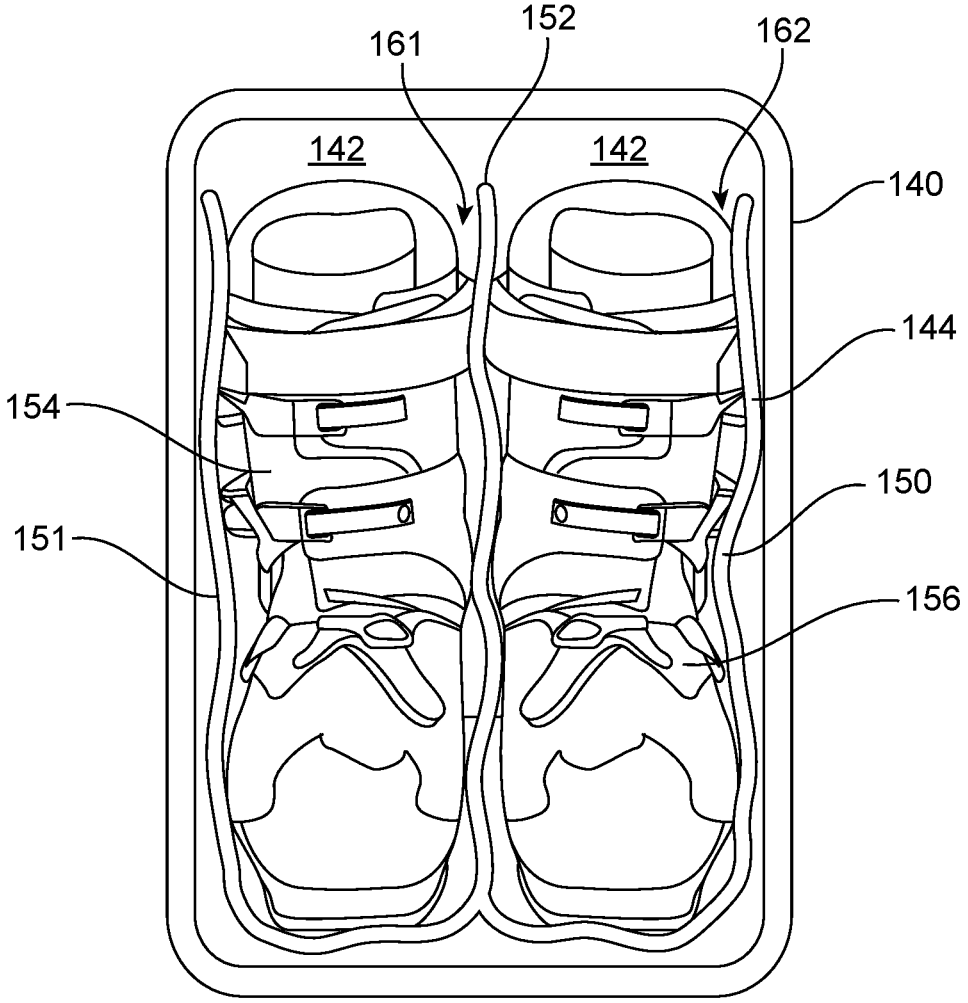
FIG. 8 is a cutaway front view of an alternative heated equipment bag in use with two ski boots.

An equipment bag may provide a large compartment in which multiple items to be heated may be placed. For example, referring to FIG. 8, an equipment bag 140 provides a compartment 142 in which a heating pad 144 is disposed. The heating pad 144 may be removed from the equipment bag 140, e.g., and replaced by a replacement heating pad. Alternatively, the heating pad 144 may be integrated into the equipment bag 140, e.g., with one or more transducers for producing heat embedded in between panels of the equipment bag 140. In the example shown in FIG. 8, the heating pad 144 is E-shaped with outer pouches 150, 151 and an inner pouch 152. The heating pad 144 defines sub-compartments 161, 162 that are configured to receive items such as pieces of footwear, here ski boots 154, 156. The equipment bag 140, e.g., a housing of the equipment bag 140, and the heating pad 144 are configured to increase a volume of the first sub-compartment 161 in response to the heating pad 144 receiving the ski boot 154 in the first sub-compartment 161 and to have the heating pad 144 conform to portions of the ski boot 154 (e.g., the pouches 151, 152 conform to exterior surface portions of the ski boot 156 contacted by the pouches 151, 152). The equipment bag 140 and the heating pad 144 may similarly adapt to the ski boot 156. The pouches 150-152 each contain a transducer (or a portion of a transducer) such that the heating pad 144 may heat both sides of both received items, here the ski boots 154, 156, received by the heating pad 144. As shown, the heating pad 144 is an integral piece, with the pouches 150-152 all part of the heating pad 144, but other configurations may be used. For example, separate pouches may be provided that are not physically connected to each other.

The invention claimed is:

1. A heated equipment bag comprising:

a housing comprising a first panel and a second panel disposed to provide a first compartment to receive a first piece of footwear between the first panel and the second panel, the housing further comprising a third panel and a fourth panel disposed to provide a second compartment to receive a second piece of footwear between the third panel and the fourth panel, the first compartment being separate from the second compartment;

a first heater disposed in the first compartment and configured to produce heat; and a second heater disposed in the second compartment and configured to produce heat;

wherein the first heater is disposed along at least first portions of the first panel and the second panel of the housing providing the first compartment to conductively transfer heat to a left side and a right side of the first piece of footwear;

wherein the second heater is disposed along at least second portions of the third panel and the fourth panel of the housing providing the second compartment to conductively transfer heat to a left side and a right side of the second piece of footwear; and wherein the housing is configured to bias the first portions of the first panel and the second panel against the first piece of footwear in response to receiving the first piece of footwear and to bias the second portions of the third panel and the fourth panel against the second piece of footwear in response to receiving the second piece of footwear.

2. The equipment bag of claim 1, wherein the first portions of the first panel and the second panel are configured to conform to an exterior surface of the first piece of footwear.

3. The equipment bag of claim 1, wherein the first portions of the first panel and the second panel are portions of sidewalls providing the first compartment and the first heater is further disposed along a bottom wall portion of the housing providing the first compartment.

4. The equipment bag of claim 3, wherein the first heater comprises a monolithic heating element disposed along the first portions of the first panel and the second panel of the housing and the bottom wall portion of the housing.

5. The equipment bag of claim 1, further comprising a shoulder strap attached to the housing.

6. The equipment bag of claim 5, wherein the housing comprises an inner sidewall and an outer sidewall providing boundary portions of the first compartment, wherein the inner sidewall is disposed closer to a vertical centerline of the equipment bag than the outer sidewall.

7. The equipment bag of claim 1, further comprising a switch coupled to the first heater and configured to be selectively actuated to control an amount of heat produced by the first heater.

8. The equipment bag of claim 1, further comprising a thermally-reflective material disposed between the first heater and a vertical centerline of the housing, or between the first heater and an exterior wall of the housing, or both.

9. The equipment bag of claim 1, wherein the first heater is disposed in a first pouch that is removably attached to the housing and the second heater is disposed in a second pouch that is removably attached to the housing.

10. A heated boot bag comprising:

a housing providing a compartment configured to receive a first boot and a second boot; and a heater disposed in the compartment and comprising:

a first heating element portion disposed along at least a portion of a first wall of the compartment;

a second heating element portion disposed along at least a portion of a second wall of the compartment, opposing the first wall of the compartment; and a third heating element portion disposed between the first heating element portion and the second heating element portion;

wherein the heater is configured to receive the first boot between the first heating element portion and the third heating element portion in a first sub-compartment defined by the heater and to receive the second boot between the second heating element portion and the third heating element portion in a second sub-compartment defined by the heater; and wherein the housing and the heater are configured to increase a volume of the first sub-compartment in response to the heater receiving the first boot in the first sub-compartment and to have the heater conform to an exterior surface of the first boot.

11. The heated boot bag of claim 10, wherein each of the first heating element portion, the second heating element portion, and the third heating element portion is flexible.

12. The heated boot bag of claim 10, wherein each of the first wall and the second wall is a respective sidewall of the compartment and the heater further comprises at least one fourth heating element portion disposed along at least a portion of a bottom of the compartment whereby the at least one fourth heating element portion will be disposed adjacent to a bottom of the first boot and a bottom of the second boot with the first boot received between the first heating element portion and the third heating element portion and the second boot received between the second heating element portion and the third heating element portion.

13. The heated boot bag of claim 10, wherein each of the first heating element portion, the second heating element portion, and the third heating element portion is a respective portion of a single heating element.

14. The heated boot bag of claim 10, wherein each of the first heating element portion, the second heating element portion, and the third heating element portion is disposed in a respective pouch.

15. A heated equipment bag comprising:

a housing comprising:

first side walls defining a first compartment to receive a first piece of footwear between the first side walls;

second side walls defining a second compartment to receive a second piece of footwear between the second side walls; and third side walls defining a third compartment between and separating the first compartment and the second compartment;

a first heater disposed in the first compartment and configured to produce heat; and a second heater disposed in the second compartment and configured to produce heat;

wherein the first heater is disposed along at least the first side walls defining the first compartment to conductively transfer heat to a left side and a right side of the first piece of footwear;

wherein the second heater is disposed along at least the second side walls defining the second compartment to conductively transfer heat to a left side and a right side of the second piece of footwear; and wherein the housing is configured to bias the first side walls against the first piece of footwear in response to receiving the first piece of footwear in the first compartment and to bias the second side walls against the second piece of footwear in response to receiving the second piece of footwear in the second compartment.

* * * * *